United States Patent [19]

Miyoshi et al.

[11] Patent Number: 4,695,233

[45] Date of Patent: Sep. 22, 1987

[54] SCREW ROTOR MECHANISM

[75] Inventors: Kiyotada Miyoshi, Kobe; Noboru Tsuboi, Kakogawa; Kunihiko Nishitani, Akashi; Kazuo Kubo, Kobe; Shouji Yoshimura, Takasago, all of Japan

[73] Assignee: Kabushiki Kaisha Kobe Seiko Sho, Kobe, Japan

[21] Appl. No.: 884,078

[22] Filed: Jul. 10, 1986

[51] Int. Cl.[4] ..... F04C 18/16; F04C 29/00

[52] U.S. Cl. ..... 418/83; 418/178; 418/201; 74/458; 74/424.5

[58] Field of Search ..... 418/83, 201, 150, 178; 74/458, 459, 424.5

[56] References Cited

U.S. PATENT DOCUMENTS 4,475,878 10/1984 Kasuya ..... 418/201

FOREIGN PATENT DOCUMENTS 37291 2/1941 Japan ..... 418/83
23365 2/1980 Japan ..... 418/201
75992 6/1981 Japan ..... 418/178
148292 2/1983 Japan ..... 418/178
29794 2/1984 Japan ..... 418/201
37290 2/1984 Japan ..... 418/201

*Primary Examiner*—Carlton R. Croyle
*Assistant Examiner*—Jane E. Obee
*Attorney, Agent, or Firm*—Oblon, Fisher, Spivak, McClelland & Maier

[57] ABSTRACT

A pair of dry-sealed screw rotors for compressors which includes rotor tooth profiles in which an inter-tooth gap at a profile point on male and female rotor of a normal temperature is determined by an amount of interference due to thermal expansion caused during the operation of the compressors and an amount of minimum safety clearance necessary for the operation. The inter-tooth gap is further determined by a total thickness of seal coatings applied to the peripheral surfaces of the rotors at a profile point at which the thus determined gap is smaller than the total thickness of seal coatings. With the thus shaped rotor teeth, a most preferable seal line is achieved so as to produce an improved compression efficiency.

1 Claim, 10 Drawing Figures

SCREW ROTOR MECHANISM

BACKGROUND OF THE INVENTION

1. Field of the Invention

The present invention relates to a screw rotor mechanism for screw compressors, and more particularly a pair of male and female screw rotors for use in dry-sealed screw compressors in which the male and female rotors are rotated by a synchronism means such as timing gears in a synchronized timing and mechanically spaced relation.

2. Description of the Prior Art

The screw rotors of this dry-sealed type are necessarily designed to maintain a gap large enough to avoid an objectionable interference therebetween which will otherwise occur mainly due to a thermal expansion thereof during its operation, particularly since the dry-sealed rotors commonly easily increase its temperature, namely up to more than 200° C.

Conventionally the dry-sealed male and female rotors are mounted within a casing of the compressor in consideration of an inter-axis distance "CD" between axes of the two rotors. Therefore the axes thereof are positioned so as to be sufficiently spaced apart from each other to thereby prevent a mechanical interference between the rotors which would otherwise occur due to the thermal expansion of the rotors during operation. An expansion amount ΔL of the two rotors is determined by $$\Delta L = CD \times \beta \times \Delta T$$

wherein $\beta$ is a linear expansion factor, and ΔT is an expected increase of temperature.

The axes of the two rotors are positioned such that a tooth tip circle of the male rotor and a root circle of the female rotor are spaced apart from each other by a distance (i.e., inter-tooth distance) determined by sum of the foregoing expansion amount and a minimum safety gap enabling operation.

In view of a compression efficiency, the inter-tooth distance is important in that an objectionable leakage of the compressed air at a suction side of the compressor can be decreased by minimizing the inter-tooth distance at a seal point between the rotors. The inter-tooth distance is determined by the foregoing inter-axis distance between the rotor axes and further by expanded tooth profiles resulted from their thermal expansion.

However, customarily such expanded tooth profiles have not been considered as a designing point for providing a minimized inter-tooth distance or gap. As a result, conventional attempts made to design an improved rotor tooth profiles without considering the thermal effect such as a thermal expansion or deformation were unsuccessful because the thus designed rotor tooth profiles inevitably deformed at an increased temperature in operation, thus deteriorating the compression efficiency.

Recently, a number of improved rotor tooth profiles have been proposed in view of the thermal expansion, as disclosed, for instance, in Japanese Patent Laid-Open Publications Nos. 57-159989, 59-37291 and 59-58189. As those documents indicate, thermal expansions occur non-uniformly or unevenly throughout respective peripheries of the male and female rotor teeth. It is well understood with reference to FIGS. 4 and 5 of the accompanying drawings in which normal-temperature tooth profiles of the male and female rotors M, F (indicated by solid line) are remarkedly different from increased-temperature tooth profiles thereof (indicated by dot-and-dash line). It can be generally observed in FIGS. 3A and 3B that the closer a tooth profile point is located to the rotor axis, the less expansion occurs. More precisely, the expansion amount at each tooth profile point can be calculated by a mathematical method such as infinite element method.

In the screw compressors of such dry-sealed type, the seal coating also affects the inter-tooth gap, in which a seal material such as a seal coating of molybdenum disulfide is applied to the peripheral surface of the rotor tooth as a lubricant for preventing an objectionable seizure caused by a direct interengagement by and between the teeth of the male and female rotors. Such seal coating applied to the rotor teeth of the foregoing prior rotors is uniform in thickness throughout the entire peripheral surfaces of the rotor teeth because relating to the restrictions of coating technique.

However, it has been found that since the thermal expansion amount varies at the tooth profile points, thus uniformly applied seal coating creates a drawback in that some tooth profile points of the male and female rotors, under the expanded condition, provide an inter-tooth gap smaller than the thickness of the seal coating applied thereto. When the seal coating thickness is greater than the inter-tooth gap as described hereinabove, the pair of male and female rotors cannot be mounted in proper intermeshing relation within the compressor casing.

SUMMARY OF THE INVENTION

According to the invention, a dry-sealed screw rotor mechanism includes a male and female rotors having rotor tooth profiles in a plane perpendicular to axes of the male and female rotors, in which the tooth profiles are determined in such a manner that normal-temperature tooth profiles of the male and female rotors having no clearance between a tip circle of the male rotor and a root circle of the female rotor in an intermeshing relation are reshaped to provide inter-tooth gaps therebetween, which are determined by the sum of an amount of interference created by a thermal expansion in the operation thereof at each point on the profile and an amount of a minimum or safety clearance necessary for enabling a proper operation thereof, and in the case where the thus determined inter-tooth gap is smaller than a total thickness of seal coatings applied to the male and female rotor peripheries at a certain profile point, the gap is reformed by an amount equal to the total thickness of seal coatings.

It is therefore an object of the present invention to provide a dry-sealed screw rotor mechanism having an improved compression efficiency in which normal-temperature tooth profiles of the male and female rotors are determined in view of increased-temperature tooth profiles or expanded tooth profiles as well as a thickness of the seal coat applied thereto.

Another object of the invention is to provide a dry-sealed screw rotor mechanism in which an inter-tooth gap or distance at a seal line between the male and female rotor teeth in operation is equal to a safety distance, i.e. an allowable minimum distance.

The above and other objects, features and advantages of the present invention will become apparent from the following description and appended claims, taken in conjunction with the accompanying drawings which show by way of example some illustrative embodiments of the invention.

DETAILED DESCRIPTION OF THE INVENTION

Figure 1:
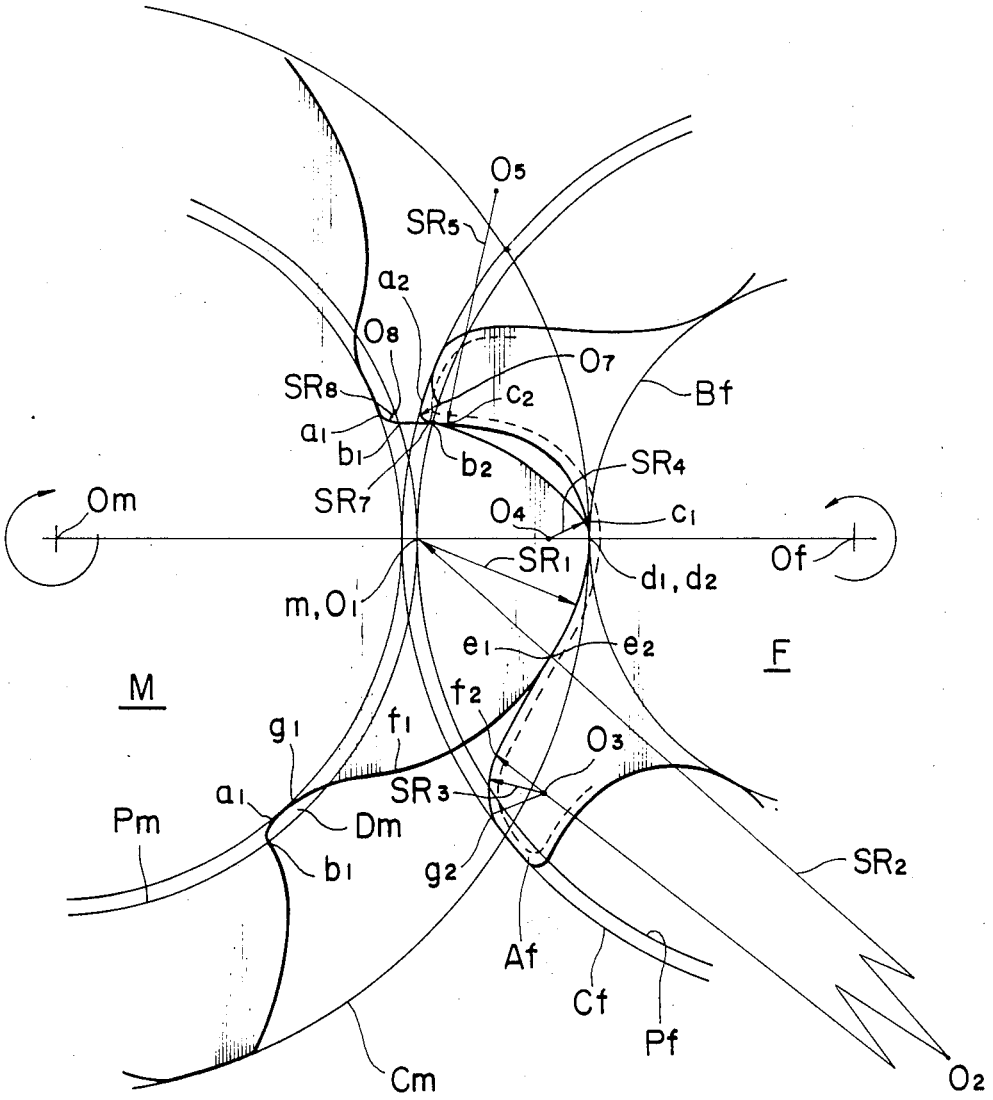
FIG. 1 is a schematical fragmentary cross-sectional view of male and female rotors embodying the invention taken on a plane perpendicular to the rotor axes, showing in solid line expected rotor tooth profiles at a normal temperature with a 'zero' gap disposed therebetween and a final female rotor tooth profile in broken line.

Male and female rotors M, F shown in FIG. 1 are so called asymmetrically toothed rotors for use in dry-sealed compressors. In FIG. 1, a solid line indicates tooth profiles of the male and female rotors M, F at a normal temperature (20° C.) which are positioned such that a gap between a tip or crest circle Cm of the male rotor M and a root or bottom circle Bf of the male rotor F is zero, in other words no clearance exists therebetween, and a broken line indicates a final tooth profile of the female rotor F which is determined in consideration of thermal expansion of the two rotors created during the operation of the compressor and an allowable minimum or safety gap required in between the tip circle Cm and the root circle Pm for enabling its proper operation.

The female and male rotors F, M shown by solid line in FIG. 1 are shaped as follows:

Female Rotor Tooth Shape

The female rotor F has an addendum Af on the outer side of a pitch circle of its teeth and tooth shapes on leading and following sides thereof as described hereinbelow.

The female rotor tooth shape on the leading side includes:

an arc $d_2$ - $e_2$ having a radius $SR_1$ and its center at an intersection $O_1$ of the pitch circle Pf and an interaxial line passing through axes Of, Om of the female and male rotors, an arc $e_2$ - $f_2$ having a radius $SR_2$ and its center at a point $O_2$ on an extension line of a radius $O_1$ - $e_2$, an arc $f_2$ - $g_2$ having a radius $SR_3$ and its center at a point $O_3$ on a radius $O_2$ - $f_2$, and an arc $g_2$ - $a_2$ overlying a tip circle Cf of the female rotor, these arcs being interconnected succeedingly in this order, wherein the point $d_2$ is located on the interaxial line Of - Om and also on the root circle Bf of the female rotor, and the point $f_2$ is on the inner side of the pitch circle Pf.

The female rotor tooth shape on the following side includes:

a generating curve $d_2$ - $c_2$ determined by an arc $d_1$ - $c_2$ of the male rotor M, an arc $c_2$ - $b_2$ having a radius $SR_5$ and its center at a point $O_5$, and an arc $b_2$ - $a_2$ having a radius $SR_7$ and its center at a point $O_7$ on the pitch circle Pf, the curve and the arcs being interconnected succeedingly in this order, wherein the point $b_2$ is located on the pitch circle Pf.

Male Rotor Tooth Shape

The male rotor M has a dedendum Dm complementary to the addendum Af of the female rotor and disposed on the inner side of a pitch circle Pm of its tooth bottoms or roots. The male rotor M also has tooth shapes on leading and following sides thereof as described hereinbelow.

The male rotor tooth shape on the leading side includes:

an arc $c_1$ - $e_1$ having a radius common to the radius $SR_1$ and its center at an intersection m of the pitch circle Pm and the interaxial line Of - Om, a generating curve $e_1$ - $f_1$ determined by the arc $e_2$ - $f_2$ of the female rotor F, a generating curve $f_1$ - $g_1$ determined by the arc $f_2$ - $g_2$ of the female rotor F, and an arc $g_1$ - $a_1$ overlying a bottom circle Bm of the male rotor, these curves and arcs being interconnected succeedingly in this order, wherein the point $d_1$ is located on the interaxial line Of - Om and also on the bottom circle Bf of the female rotor, and the point $f_1$ is on the outer side of the pitch circle Pm.

The male rotor tooth shape on the following side includes:

an arc $d_1$ - $c_1$ having a radius $SR_4$ and its center at a point $O_4$ on the interaxial line Of - Om, a generating curve $c_1$ - $b_1$ determined by the arc $b_2$ - $c_2$ of the female rotor F, and an arc $b_1$ - $a_1$ having a radius $SR_8$ and its center at a point $O_8$ on the pitch circle Pm, the arcs and the curve being interconnected succeedingly in this order, wherein the point $b_1$ is located on the pitch circle Pm.

In this particular embodiment of the invention, a distance between the axes of the male and female rotors is 67 mm, the number of teeth of the male rotor M is fine, a diameter of the pitch circle Pm is 60.909 mm, the number of teeth of the female rotor F is six, a diameter of the tip circle Cf is 76 mm, and a diameter of the pitch circle Pf is 73.091 mm.

Figure 2:
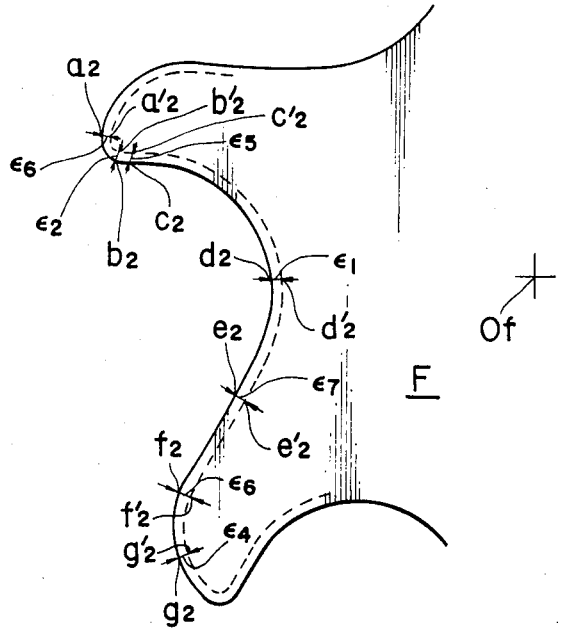
FIG. 2 is a schematical fragmentary cross-sectional view, showing a gap between the expected tooth profile and final tooth profile of the female rotor of FIG. 1.

In order to determine respective normal-temperature tooth shapes of the male and female rotors in consideration of thermal expansion created on each rotor during the operation of the compressor, thermally expanded tooth shapes are formed by calculating the thermal expansion factors based on the normal rotor tooth shapes of FIGS. 1 and 2, and then the thus formed imaginary rotors are rotated to ascertain any interference which has occurred at various profile points. The foregoing thermal expansion factors are given on the assumption that the temperature of the rotors is 200° C.

FIG. 3A

Figure 3A:
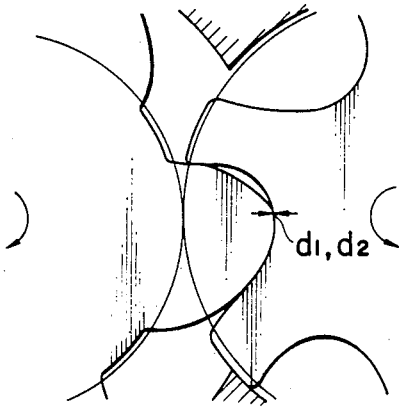
FIGS. 3A–3F are schematical fragmentary cross-sectional views of the male and female rotors, showing the manner in which the rotors interfere with each other at different rotating positions, respectively.

FIG. 3A shows the manner in which male and female rotors respectively identical with the male and female rotors of FIG. 1 are intermeshed with each other. Such intermeshing state is referred to as the zero rotation angle of the rotors. In this zero rotation angle, the profile points $d_1$, $d_2$ are in contact with each other to thereby define one of the points on the seal line of the two rotors. A mechanical interference amount $\epsilon_1'$ by and between the points $d_1$, $d_2$ is 160 μm.

FIG. 3B

Figure 3B:
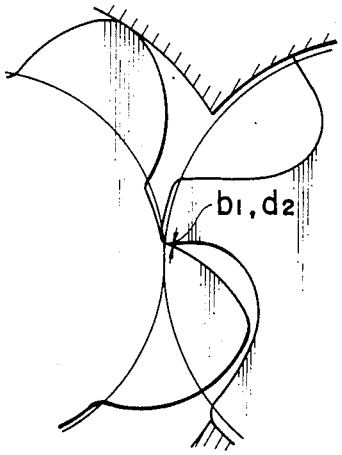

In FIG. 3B, the two rotors are intermeshed with each other at a rotation angle of 12°, in which the points $b_1$ and $b_2$ are in contact with each other to define a point of the seal line. A mechanical interference amount $\epsilon_2'$ by and between the points $b_1$ and $b_2$ is 60 μm.

FIG. 3C

Figure 3C:
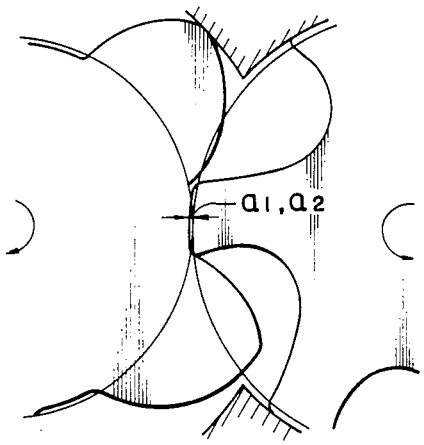

In FIG. 3C, the two rotors are intermeshed with each other at a rotation angle of 24°, in which two pairs of the points $a_1$ and $a_2$ and the points $g_1$ and $g_2$ are respectively in contact with each other to define respective seal line points. Mechanical interference amounts $\epsilon_3'$ and $\epsilon_4'$ by and between the points $a_1$ and $a_2$ and the points $g_1$ and $g_2$ are commonly 160 μm.

FIG. 3D

Figure 3D:
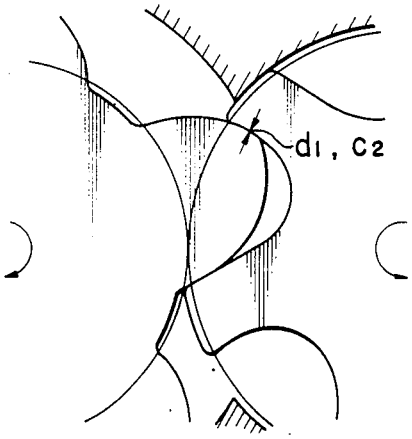

In FIG. 3D, the two rotors are intermeshed with each other at a rotation angle 48°, in which the points $d_1$ and $c_2$ are in contact with each other to define a point on the seal line. Interference amount $\epsilon_5'$ by and between the points $d_1$ and $d_2$ is 130 μm.

FIG. 3E

Figure 3E:
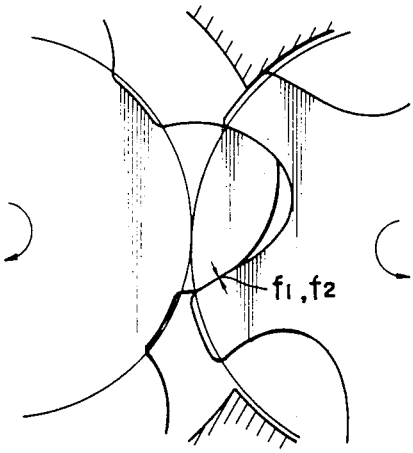

In FIG. 3E, the two rotors are intermeshed with each other at a rotation angle of 54°, in which the points $f_1$ and $f_2$ are in contact with each other to define a point on the seal line. Interference amount $\epsilon_6'$ by and between the points $f_1$ and $f_2$ is 60 μm.

FIG. 3F

Figure 3F:
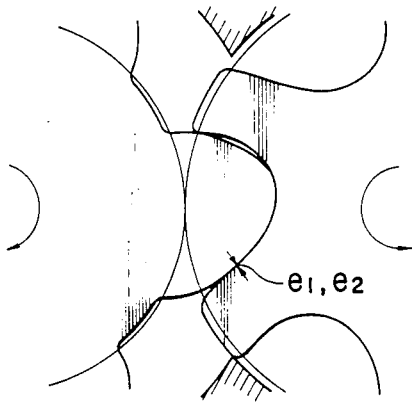
Figure 4:
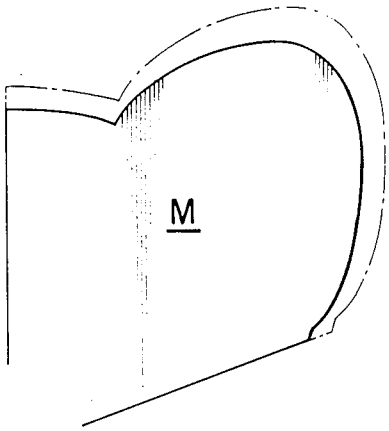
FIGURE 4 PRIOR ART
FIG. 4 is a fragmentary cross-sectional view of a typical male rotor, showing its thermal expansion.
Figure 5:
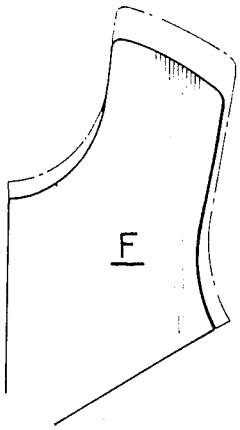
FIGURE 5 PRIOR ART
FIG. 5 is a fragmentary cross-sectional view of a typical female rotor, showing its thermal expansion.

In FIG. 3F, the two rotors are intermeshed with each other at a rotation angle of 66°, in which the points $e_1$ and $e_2$ are in contact with each other to define a point on the seal line. Interference amount $\epsilon$hd 7' by and between the points $e_1$ and $e_2$ is 60 μm.

Thus determined interference amounts $\epsilon_1'$- $\epsilon_7'$ created by the thermal expansion between those points are used to reshape the respective tooth shapes of the male and female rotors at a normal temperature shown by the solid line in FIG. 1. Such reshaping may be exerted selectively either of the male and female rotors or both of them. In this embodiment, the male rotor M maintains its original tooth shape as a reference tooth shape, while only the female rotor F is reshaped accordingly. Thus interference due to the thermal expansion is absorbed by reshaping the female rotor tooth shape.

In addition to the thermal expansion, other designing factors have to be taken into account to achieve a suitable operation of the rotors in compressors. Namely, a safety clearance or gap between the rotors is provided for enabling the proper operation thereof in view of a machining or manufacturing tolerance, a backlash of the timing gears and/or the like. Such safety clearance is generally 20 μm on the normal tooth profiles. Also the thickness of the seal coating applied to the periphery surfaces of the rotor teeth for preventing a seizure is important. Such thickness is generally 35 μm–45 μm on the normal tooth profiles. The thickness is determined so as to provide a gap large enough to allow for the applying of the coating.

Table 1 shown below indicates exemplary values of an inter-tooth gap at the points $a_2$ - $g_2$ of the female rotor F. Table 1 is described hereinbelow.

TABLE 1

| Female rotor tooth profile point | No. 1 Interference due to thermal expansion in plane P/A ($\epsilon'$) | No. 2 Interference due to thermal expansion in plane N/T | No. 3 Safety clearance in plane N/T added to No. 2 | No. 4 Controlled in view of seal coat thickness in plane N/T | No. 5 Final inter-tooth gap in plane P/A ($\epsilon$) |
|---|---|---|---|---|---|
| $a_2$ | $\epsilon_3'$ (160 μm) | 160 μm | 180 μm | 180 μm | $\epsilon_3$ (180 μm) |
| $b_2$ | $\epsilon_2'$ (60 μm) | 37 μm | 57 μm | 70 μm | $\epsilon_2$ (110 μm) |
| $c_2$ | $\epsilon_5'$ (130 μm) | 91 μm | 111 μm | 111 μm | $\epsilon_5$ (160 μm) |
| $d_2$ | $\epsilon_1'$ (160 μm) | 16 μm | 180 μm | 180 μm | $\epsilon_1$ (180 μm) |
| $e_2$ | $\epsilon_7'$ (60 μm) | 48 μm | 68 μm | 70 μm | $\epsilon_7$ (110 μm) |
| $f_2$ | $\epsilon_6'$ (60 μm) | 41 μm | 61 μm | 70 μm | $\epsilon_6$ (110 μm) |
| $g_2$ | $\epsilon_4'$ (160 μm) | 160 μm | 180 μm | 180 μm | $\epsilon_4$ (180 μm) |

Column No. 1 indicates the foregoing interference amount $\epsilon'$ due to thermal expansion at the female rotor tooth profile points $a_2$ - $g_2$ in a plane perpendicular to the rotor axes. Column No. 2 indicates an interference amount due to thermal expansion in a plane normal to one female rotor tooth which is converted from the amount $\epsilon'$ of Column No. 1. Column No. 3 indicates the sum of a safety clearance on the normal tooth profile, i.e. 20 μm and the interference amount of Column No. 2. Column No. 4 indicates a controlled value for use in shaping the female rotor tooth in the plane perpendicular to the rotor axes which is determined in consideration of the thickness of the seal coating, i.e. 35 μm (total thickness of the seal coating applied to the male and female rotors is 35 μm×2). If the amount in Column No. 3 is less than the total thickness, i.e. 70 μm (35 μm×2), 70 μm is employed. Namely, this value 70 μm is employed at the point $b_2$, $e_2$, $f_2$. Column No. 5 indicates a final dimensional value, that is, a final inter-tooth gap dimension $\epsilon(\epsilon_1$ - $\epsilon_7)$ on the tooth profile in a plane perpendicular to the rotor axes which is converted from the amount in Column No. 4. The thus determined inter-tooth gaps $\epsilon_1$ - $\epsilon_7$ are illustrated in FIG. 2.

The final female rotor tooth shapes shown by the broken line in FIG. 2 is described hereinbelow in connection with the starting female rotor tooth shapes shown by the solid line in FIG. 2. Tooth profile points $a_2'$ - $g_2'$ on the final tooth shape of broken line correspond to the points $a_2$ - $g_2$ of the starting tooth shape of solid line.

Profile $a_2'$ - $b_2'$ is an arc having a gap $\epsilon_3$ between points $a_2'$ and $a_2'$ and a gap $\epsilon_2$ between points $b_2'$ and $b_2'$.

Profile $b_2'$ - $c_2'$ is an arc having the gap $\epsilon_2$ between the points $b_2'$ and $b_2$ and a gap $\epsilon_5$ between points $c_2'$ and $c_2$.

Profile $c_2'$ - $d_2'$ is a corrected generating curve having the gap $\epsilon_5$ between the points $c_2'$ and $c_2$, and a gap $\epsilon_1$ between points $d_2'$ and $d_2$.

Profile $d_2'$ - $e_2'$ is an arc having the gap $\epsilon_1$ between the points $d_2'$ and $d_2$, and a gap $\epsilon_7$ between points $d_2'$ and $e_2$.

Profile $e_2'$ - $f_2'$ is an arc having the gap $\epsilon_7$ between the points $e_2'$ and $e_2$, and a gap $\epsilon_6$ between points $f_2'$ and $f_2$.

Profile $f_2'$ - $g_2'$ is an arc having the gap $\epsilon_6$ between the points $f_2'$ and $f_2$, and a gap $\epsilon_4$ between points $g_2'$ and $g_2$.

A seal coating with a thickness of 35 μm is applied to the peripheral surfaces of the female rotor having the foregoing tooth shape (in broken line) and the male rotor having the tooth shape (in solid line) for thereby preventing objectionable seizure. Then the thus coated rotors are mounted in an intermeshing relation in a compressor casing. Theoretically an inter-surface gap between the thus applied seal coating peripheral surfaces of the male and female rotors is zero at points $b_1$ - $b_2'$; $e_1$ - $e_2'$; and $f_1$ - $f_2'$, and a certain dimensional value more than zero at the other points. Accordingly an objectionable mechanical interference will not occur between the seal coatings on the male and female rotors when the latter are snugly installed into the compressor casing, thus enabling a suitable assembling of the rotors. In operation, when the temperature of the rotors reaches to 200° C., i.e. the initial set temperature, the theoretical inter-tooth gaps at the seal lines become zero clearance, with the result that a most preferable compression efficiency is achieved. To describe this more precisely, a gap between the outermost peripheral surfaces of the rotor teeth is narrower than the foregoing safety clearance since there exists the seal coatings on each tooth surface.

With thus shaped rotor profiles, in which a normal-temperature tooth profile is designed in view of an expected variable factor such as a thermal expansion, the inter-tooth gaps at seal lines of the rotors in operation become a minimum allowable dimension equal to a safety gap, thus defining most preferable seal lines, which achieve an improved compression efficiency.

Obviously, numerous modifications and variations of the present invention are possible in light of the above teachings. It is therefore to be understood that within the scope of the appended claims, the invention may be practiced otherwise than as specifically described herein.

What is claimed is:

1. A screw rotor of a dry type compressor comprising:

a male and female rotor, said male and female rotor including in a plane perpendicular to axes of said rotors respective rotor tooth profiles which are formed from normal-temperature tooth profiles of basic male and female rotors having no clearance between a tip circle of said basic male rotor and a root circle of said basic female rotor wherein said male and female rotors include a seal coating of 35 μm–45 μm on the peripheral surfaces of said rotors and said normal-temperature tooth profiles at each profile point include a first inter-tooth gap determined by a sum of an amount of interference created by a thermal expansion at said profile point during the operation of the compressors and an amount of minimum safety clearance necessary for said operation, and further an inter-tooth gap is reformed by an amount, equal to a total thickness of seal coatings applied to said male and female rotors, at a predetermined profile point at which the determined inter-tooth gap is smaller than said total thickness of seal coatings.

* * * * *